US006079342A

United States Patent [19]

Tseng

[11] Patent Number: 6,079,342

[45] Date of Patent: Jun. 27, 2000

[54] NEEDLE SUPPORT FOR SEWING MACHINE

[76] Inventor: Hsien Chang Tseng, 9F., No. 270, Gau Gong Road, Taichung, Taiwan

[21] Appl. No.: 09/243,594

[22] Filed: Feb. 3, 1999

[51] Int. Cl.[7] ..... D05B 55/02

[52] U.S. Cl. ..... 112/226

[58] Field of Search ..... 112/226, 225, 112/80.4, 80.5

[56] References Cited

U.S. PATENT DOCUMENTS

| | | | |
|---|---|---|---|
| 1,430,930 | 10/1922 | Berger | 112/226 |
| 2,792,798 | 5/1957 | Zink | 112/226 |
| 3,348,508 | 10/1967 | Eguchi et al. | 112/226 |
| 3,598,345 | 6/1971 | Wilson, III | 112/226 |

FOREIGN PATENT DOCUMENTS

| | | | |
|---|---|---|---|
| 458025 | 6/1966 | Japan | 112/226 |

*Primary Examiner*—Ismael Izaguirre
*Attorney, Agent, or Firm*—Charles E Baxley, Esq.

[57] ABSTRACT

A needle support for securing needles to a sewing machine includes a block having a flat surface for engaging with the flat portions of the needles. A cap is secured to the block and has one or more channels for engaging with the curved portion of the needle. The block may include one or more grooves and each having a flat surface for engaging with the flat portions of the needles. The block may include one or more curved grooves formed in the opposite surface for engaging with the curved portions of the needles whose flat portions are engaged with the flat surface of another cap.

10 Claims, 4 Drawing Sheets

NEEDLE SUPPORT FOR SEWING MACHINE

BACKGROUND OF THE INVENTION

1. Field of the Invention

The present invention relates to a needle support, and more particularly to a needle support for a sewing machine.

2. Description of the Prior Art

The recently developed sewing machines comprise a needle support for supporting two or more needles. The needle supports are manufactured, with a mold process, to a block having two or more holes formed therein. The needles each includes an upper end having a flat surface for aligning or for calibrating purposes. However, one or more times of electric spark machining processes are required for forming the holes having the required precision. It is time consuming to operate the electric spark machining processes. Some of the needle support may be used for supporting up to five needles, such that five or ten times of electric spark machining processes are required for forming five holes in a single needle support. In addition, only the holes having the circular cross section may be formed with the electric spark machine, such that the specialized persons are required for aligning or for calibrating the needles.

The present invention has arisen to mitigate and/or obviate the afore-described disadvantages of the conventional needle supports for sewing machines.

SUMMARY OF THE INVENTION

The primary objective of the present invention is to provide a needle support which may be easily and quickly manufactured with the desired precision.

In accordance with one aspect of the invention, there is provided a needle support for securing at least one needle to a sewing machine, the needle including a flat portion and a curved portion, the needle support comprising a block for attaching to the sewing machine, the block including at least one flat surface formed therein for engaging with the flat portion of the needle, a cap including at least one channel formed therein for engaging with the curved portion of the needle, and means for securing the cap to the block and to secure the needle between the block and the cap.

The block includes at least one groove formed therein and having a base portion, the flat surface of the block is formed in the base portion of the block.

A stop means is further provided for preventing the needle from being disengaged from the block and the cap.

The block includes a side portion, the cap includes a flap extended therefrom for engaging with the side portion of the block, and means for securing the flap of the cap to the block.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
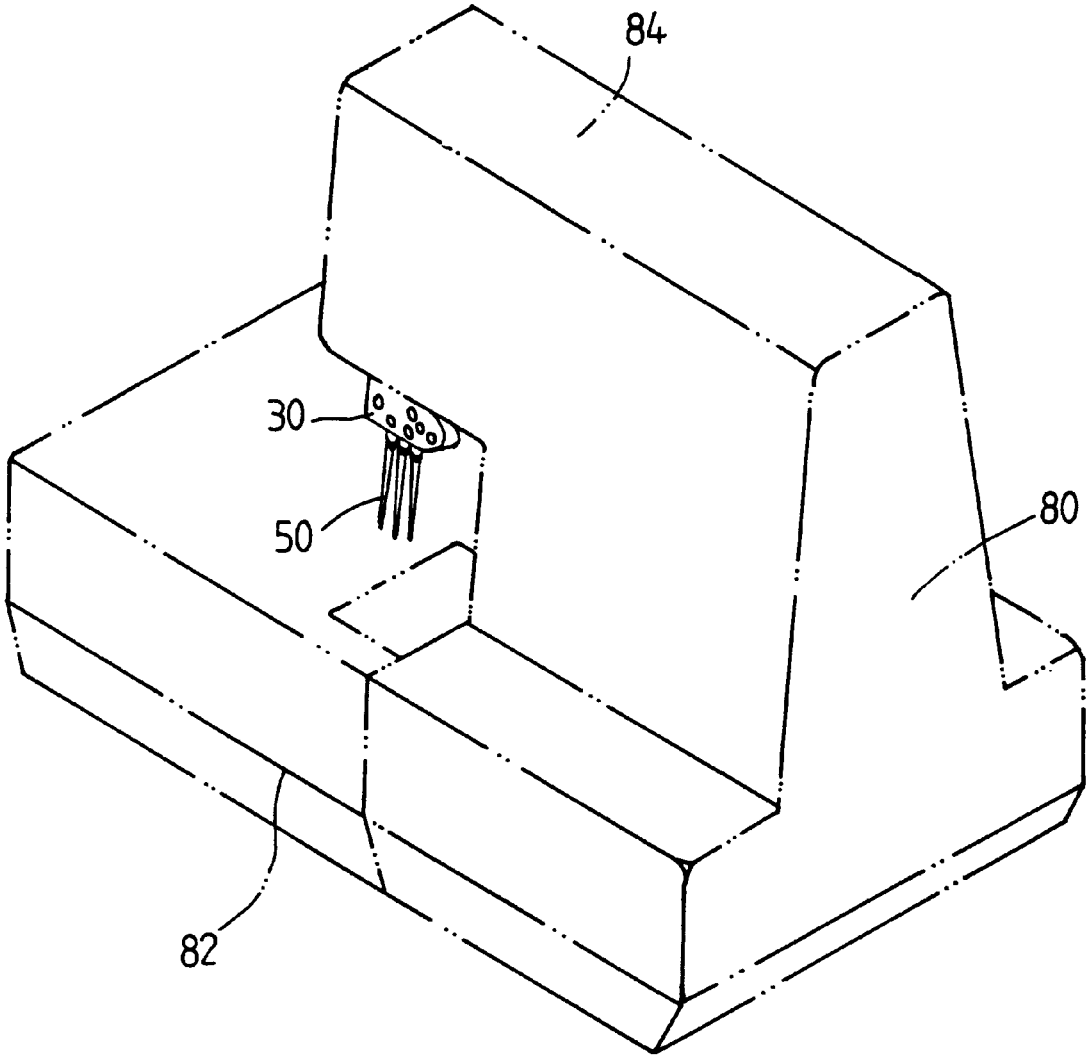
FIG. 1 is a partial perspective view of a sewing machine having a needle support in accordance with the present invention.
Figure 2:
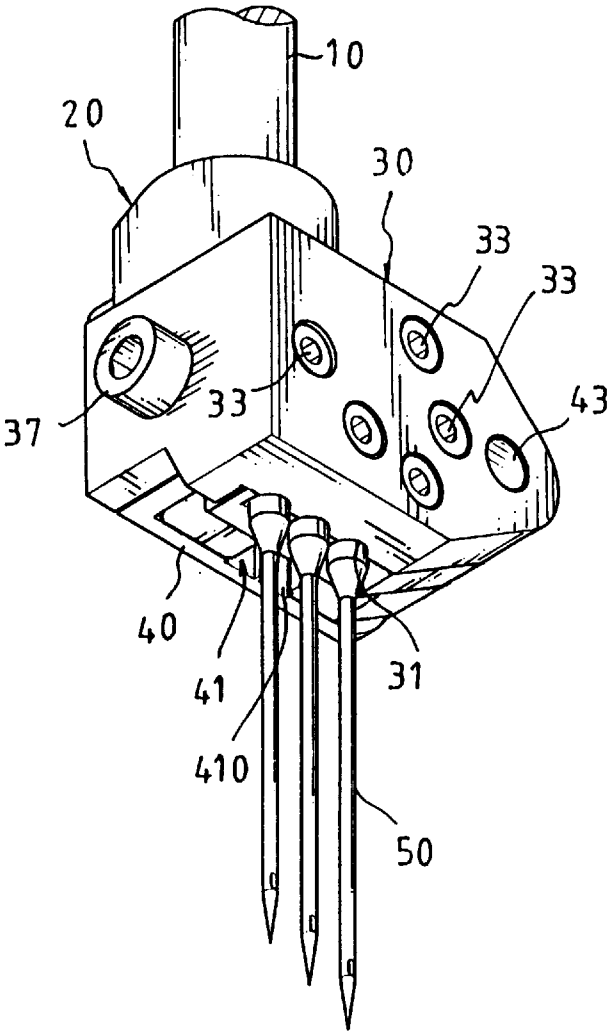
FIG. 2 is a perspective view of the needle support.

Referring to the drawings, and initially to FIG. 1, a needle support in accordance with the present invention is to be attached to an arm of a sewing machine 80 in which the arm 84 is disposed above a base 82. As shown in FIGS. 2–5, the needle support comprises a block 20 having an aperture 21 formed in the upper end for receiving the needle bar 10 and having a screw hole or a puncture 22 formed therein for receiving the fastener 23 which may solidly secure the block 20 to the needle bar 10. The needle bar 10 is to be operated and moved tip and down in order to move the needle support in a reciprocating action.

Figure 5:
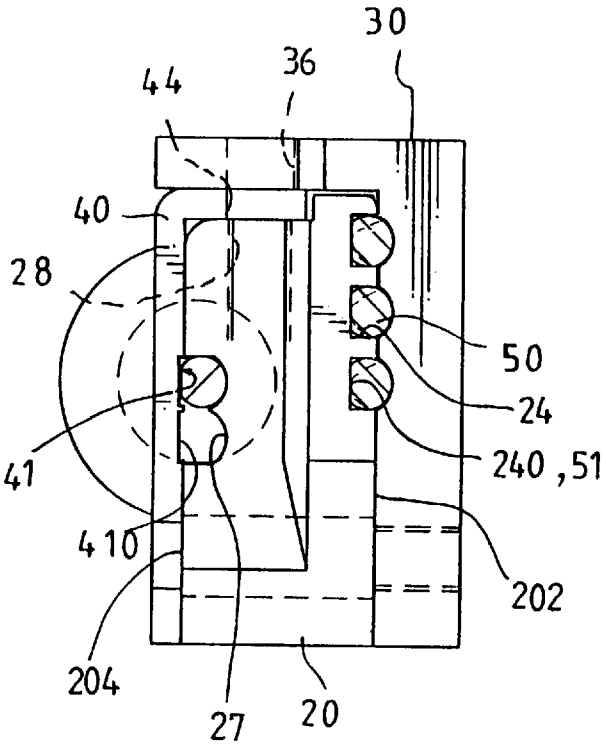
FIG. 5 is a bottom view of the needle support.

The block 20 includes a side surface or a front surface 202 having one or more grooves 24 formed therein for receiving the needles 50 and each defined by a flat base surface 240 for engaging with the flat surface 51 that is formed in the needles 50 (FIG. 5). The block 20 includes a side surface or a rear surface 204 having one or more grooves 27 formed therein for receiving the other needles 50. As shown in FIG. 5, three needles 50 are engaged in the front surface 202 of the block 20 and two needles 50 are engaged in the rear surface 204 of the block 20. The block 20 includes two screw holes 25 formed therein and aligned with the grooves 27 respectively for receiving fasteners 33 which may secure the needles 50 in place.

A front cap 30 and a rear cap 40 are secured to the front portion and the rear portion of the block 20 respectively. One or more fasteners 43 are engaged through the holes 42 of the cap 40 and the holes 26 of the block 20 and engaged with the screw holes 35 of the cap 30 so as to solidly secure the caps 30, 40 to the block 20. The caps 30, 40 each includes a flap 302, 402 extended perpendicular to the respective caps 30, 40 for engaging with one side portion of the block 20 (FIG. 5). One or more fasteners 37 are engaged through the holes 36 of the cap 30 and the holes or the notches 44 of the cap 40 and engaged with the screw holes 28 of the block 20 so as to further solidly secure the caps 30, 40 to the block 20. The cap 30 includes two openings 34 formed therein and aligned with the screw holes 25 of the block 20 for allowing the fasteners 33 to be engaged into the screw holes 25.

The front cap 30 includes one or more channels 31 formed therein for receiving the needles 50 and includes one or more stops 310 extended inward of the channels 31 for engaging with the needles 50 and for preventing the needles 50 from disengaging from the block 20 and the cap 30. The cap 30 includes one or more screw holes 32 formed therein and aligned with the channels 31 respectively for receiving the fasteners 33 which may solidly secure the needles 50 in place. The rear cap 40 includes one or more channels 41 formed therein for receiving the needles 50 and defined by a flat base surface 410 which may engage with the flat surface 51 of the needle 50. The block 20 or the cap 40 may include one or more stops extended inward of the channels 41 for engaging with the needles 50 and for preventing the needles 50 from disengaging from the block 20 and the cap 40. The fasteners 33 engaged through the holes 34 of the cap 30 and threaded with the screw holes 25 of the block 20 may secure the needles 50 between the cap 40 and the block 20.

The engagement of the flat surfaces 240 of the block 20 with the flat surfaces 51 of the needles 50 and the engagement of the flat surfaces 410 of the cap 40 with the flat surfaces 51 of the needles 50 are provided for alignment or calibrating purposes, such that no specialized persons are required for assembling the needles 50. The grooves 24, 27 of the block 20 and the channels 31, 41 of the caps 30, 40 are opened and may be easily and quickly machined to an accurate size and shape.

Figure 3:
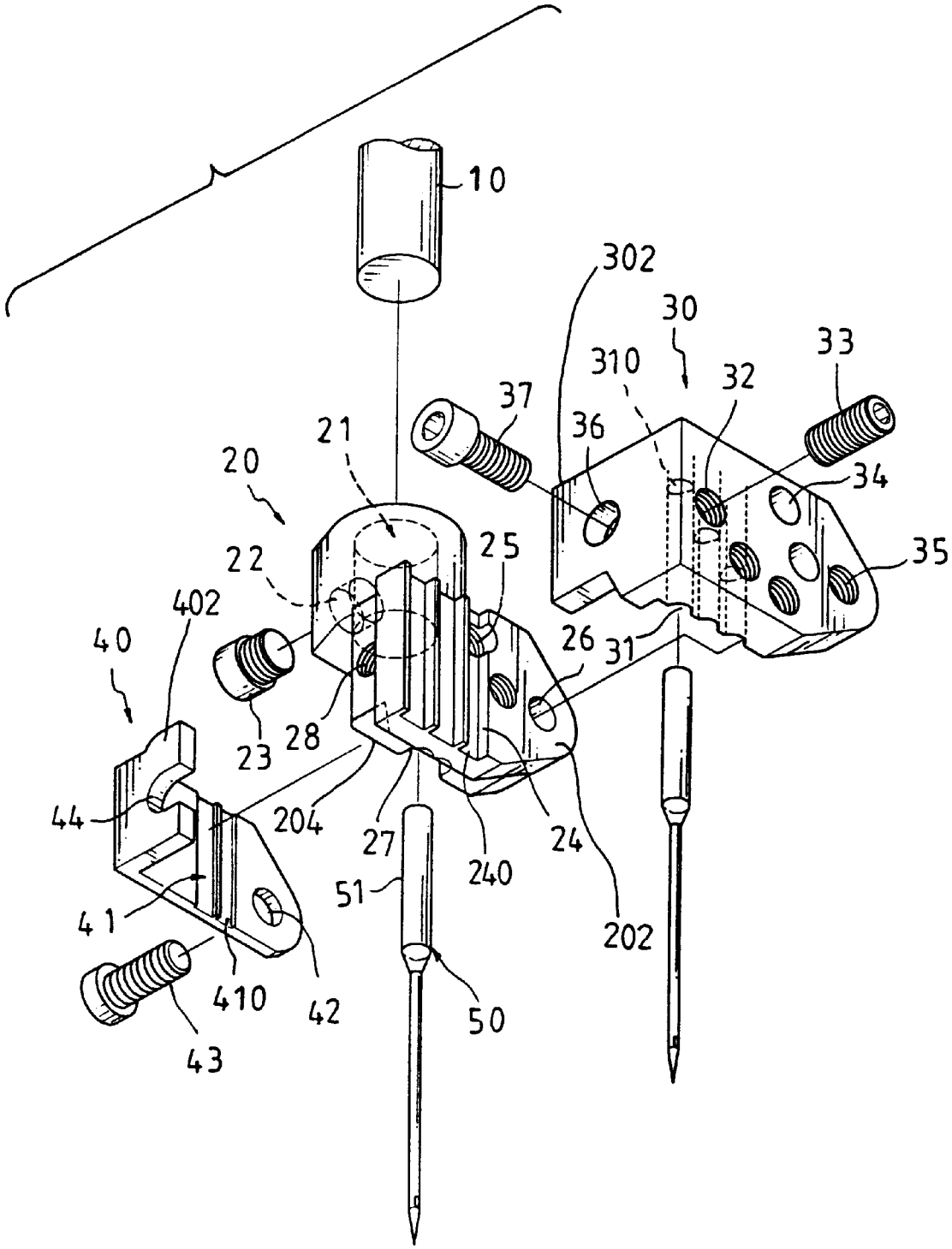
FIG. 3 is an exploded view of the needle support.
Figure 4:
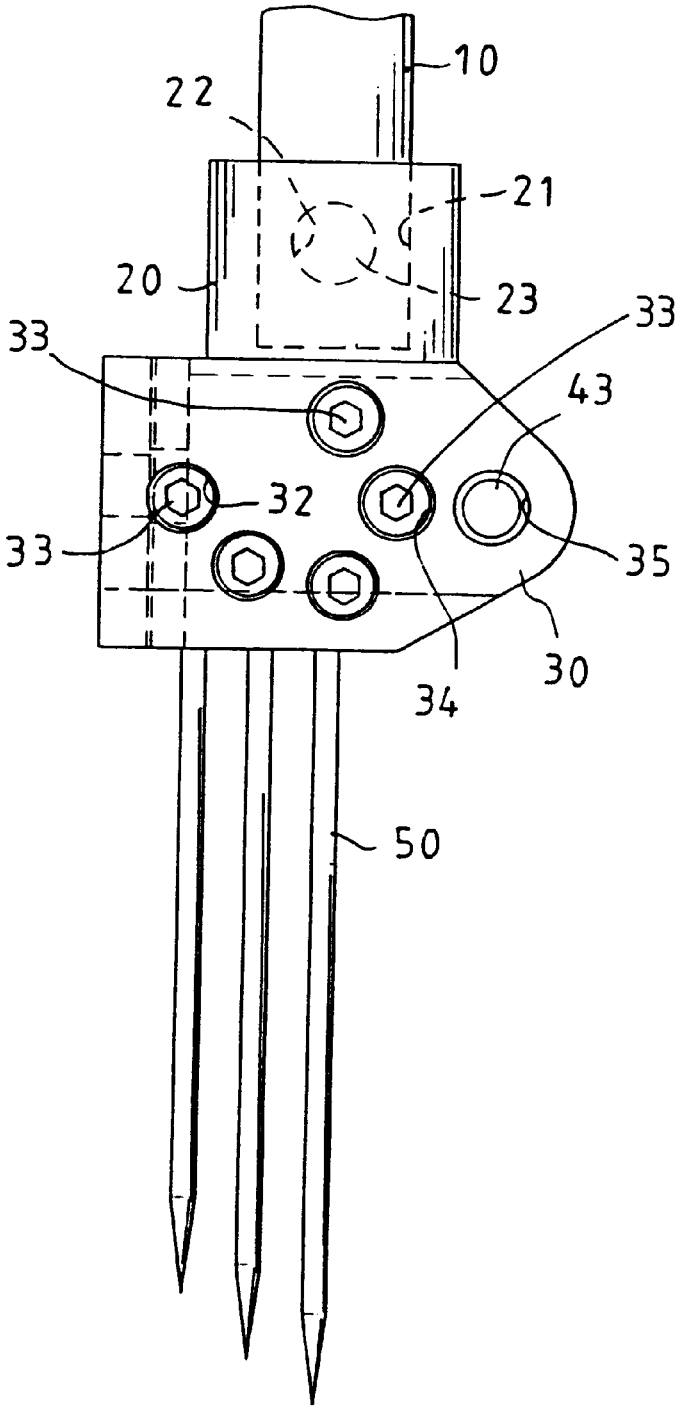
FIG. 4 is a plan view of the needle support.

As shown in FIGS. 3 and 5, the groove 27 of the block 20 and the channel 31 of the cap 30 each includes a curved or semi-circular cross section for engaging with the curved portion of the needles 50. The groove 24 of the block 20 and the channel 41 of the cap 40 each includes a flat base surface 240, 410 for engaging with the flat port ion 51 of the needles 50. Alternatively, the groove 27 of the block 20 and the channel 31 of the cap 30 may each include a flat base surface for engaging with the flat portion of the needles 50; and the groove 24 of the block 20 and the channel 41 of the cap 40 may each include a curvature for engaging with the curved portion of the needles 50.

Further alternatively, the block 20 and the cap 40 may each include a flat surface for engaging with the flat portions 51 of the needles 50 without forming the grooves 24 in the block 20 and the channels 41 in the cap 40.

Accordingly, the needle support in accordance with the present invention may be easily and quickly manufactured with the desired precision.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A needle support for securing at least one needle to a sewing machine, the at least one needle including a flat portion and a curved portion, said needle support comprising:

a block for attaching to the sewing machine, said block including at least one flat surface formed therein for engaging with the flat portion of the at least one needle, said block including a side portion, a cap including at least one channel formed therein for engaging with the curved portion of the at least one needle, said cap including a flap extended therefrom for engaging with said side portion of said block, and means for securing said flap of said cap to said block and to secure the at least one needle between said block and said cap.

2. The needle support according to claim 1, wherein said block includes at least one groove formed therein and having a base portion, said at least one flat surface of said block is formed in said base portion of said block.

3. The needle support according to claim 1 further comprising stop means for preventing the at least one needle from being disengaged from said block and said cap.

4. A needle support for securing at least one needle to a sewing machine, the at least one needle including a flat portion and a curved portion, said needle support comprising:

a block for attaching to the sewing machine, said block including at least one groove formed therein for engaging with the curved portion of the at least one needle, said block including a side portion.

a cap including at least one flat surface formed therein engaging with the flat portion of the at least one needle, said cap including a flap extended therefrom for engaging with said side Portion of said block, and means for securing said flap of said cap to said block and to secure the at least one needle between said block and said cap.

5. The needle support according to claim 4, wherein said cap includes at least one channel formed therein and having a base portion, said at least one flat surface of said cap is formed in said base portion of said cap.

6. A needle support for securing needles to a sewing machine, the needles each including a flat portion and a curved portion, said needle support comprising:

a block for attaching to the sewing machine, said block including a front portion having at least one flat surface formed therein for engaging with the flat portion of the needle and including a rear portion having at least one groove formed therein for engaging with the curved portion of the needle, a first cap secured to said front portion of said block and including at least one channel formed therein for engaging with the curved portion of the needle, and a second cap secured to said rear portion of said block and including at least one flat surface formed therein for engaging with the flat portion of the needle.

7. The needle support according to claim 6, wherein said block includes at least one groove formed in said front portion thereof and having a base portion, said at least one flat surface of said block is formed in said base portion of said block.

8. The needle support according to claim 6 further comprising stop means for preventing the needle from being disengaged from said block and said first cap.

9. The needle support according to claim 6, wherein said block includes a side portion, said first cap and said second cap each includes a flap extended therefrom for engaging with said side portion of said block, and means for securing said flaps of said first cap and said second cap to said block.

10. A needle support for a sewing machine, said needle support comprising:

a block for attaching to the sewing machine, said block including a front portion and including a rear portion, a first cap engaged onto said front portion of said block, at least one first needle disposed between said first cap and said front portion of said block, a second cap engaged onto said rear portion of said block, at least one second needle disposed between said second cap and said rear portion of said block, and means for securing said at least one first needle between said first cap and said front portion of said block and for securing said at least one second needle between said second cap and said rear portion of said block.

* * * * *